US011100752B2

(12) United States Patent
Culp et al.

(10) Patent No.: US 11,100,752 B2
(45) Date of Patent: Aug. 24, 2021

(54) SERVICE LIGHTING CONTINUATION FOR GAMING CABINETS

(71) Applicant: AGS LLC, Las Vegas, NV (US)

(72) Inventors: Sean Richard Culp, Kansas City, KS (US); Emery Hobart Redenius, Las Vegas, NV (US); Eric Laurence Abbott, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 198 days.

(21) Appl. No.: 16/256,924

(22) Filed: Jan. 24, 2019

(65) Prior Publication Data

US 2020/0242885 A1 Jul. 30, 2020

(51) Int. Cl.
*G07F 17/32* (2006.01)

(52) U.S. Cl.
CPC ..... *G07F 17/3216* (2013.01); *G07F 17/3223* (2013.01); *G07F 17/3241* (2013.01)

(58) Field of Classification Search
CPC ..... G07F 17/3216; G07F 17/3223; G07F 17/3241
See application file for complete search history.

(56) References Cited

U.S. PATENT DOCUMENTS

2006/0097868 A1* 5/2006 Ingram ..... G07F 9/02 340/571
2008/0113708 A1* 5/2008 Beadell ..... A63F 13/08 463/16
2010/0248814 A1* 9/2010 Carson, Jr. ..... G07F 17/3241 463/25
2012/0026726 A1* 2/2012 Recker ..... H01Q 1/44 362/157
2016/0019736 A1* 1/2016 Radicella ..... G07C 9/00182 235/382
2017/0111520 A1* 4/2017 Bowers ..... H04M 17/02

FOREIGN PATENT DOCUMENTS

CN 204256137 U * 4/2015 ..... G01R 31/36

* cited by examiner

*Primary Examiner* — Evan P Dzierzynski
(74) *Attorney, Agent, or Firm* — Weide & Miller, Ltd.

(57) ABSTRACT

A gaming machine is provided having a cabinet with one or more technician accessible and normally locked compartments that include respective compartment service lights. A respective gaming power supply node is provided in at least one of the compartments where power is supplied to that node for a limited time during servicing. In order to allow for long durations of service lighting in the compartment, a service backup battery is added to the compartment. A power selecting circuit is employed to automatically select either the service backup battery or the gaming power supply node for supplying power to service lights in the compartment.

27 Claims, 8 Drawing Sheets

SERVICE LIGHTING CONTINUATION FOR GAMING CABINETS

TECHNICAL FIELD

The present disclosure of invention relates to operations of gaming machines within a gaming environment.

BACKGROUND

Slot-type electronic and/or mechanical gaming machines, often also referred as slot machines or gaming machines, are popular fixtures in casino or other gaming environments. Such slot machines are generally operated by use of various electronic and/or electromechanical and/or electro-optical components as well as installed software programs that enable rapid and reliable gaming action. Aside from slot machines, various other kinds of gaming devices may populate the casino floor, including electronically-assisted gaming tables which are also generally operated by use of various electronic and/or electromechanical and/or electro-optical components as well as installed software programs. A typical gaming environment (e.g., a casino) often has large arrays of side-by-side gaming devices (e.g., slot machines, gaming tables, chip and/or cash dispensing stations and other ancillary devices) that are laid out in accordance with a predetermined floor plan and made available for play and/or observation by large numbers of people. A typical floor plan includes close groupings of gaming machines that implement a same game or game type so that side-by-side players can share substantially same experiences while at their respective machines. The typical floor plan also includes narrow footpaths between machines of same grouping as well as wider footpaths for supporting larger customer foot traffic to and from the close packed machines. Additionally, the typical floor plan will place various service resources such as restrooms, snack stations, cashier booths, information desks at ends or intersections of the wider footpaths so that customers may conveniently get to them. In order to provide for desired psychological optical experience by patrons, ceiling lights are often dim so that most of the optical experience arises from lights and displays provided by the gaming machines themselves.

For sake of security, gaming devices and ancillary equipment are generally housed in securely closed cabinets that themselves may include further and internally locked security boxes. The cabinets and/or more interior security boxes typically have respective mechanical door switches for sensing door open conditions so that these door open conditions can be processed by appropriate software. On occasion, these securely closed cabinets and/or internally locked further security boxes need to be opened for servicing by a floor technician. Examples include those were paper or cash jams occur or where tilt conditions arise. When access to secured portions of the cabinet is detected by internal gaming control circuits (due to sensing by the door switches), the gaming machine will typically automatically power itself down after having saved crucial data to non-volatile secured memory and issued an alert for technician assistance. Technician accessible secured portions of the machine into which service technicians sometimes need to gain access often include a service light for allowing the technician to see into the cabinet portion despite the dim overhead lighting and the limited door access area of the respective cabinet portion. In some cases the internal gaming control circuits of the machine shut off power to all parts of the machine, including to the internal service lights before the technician has had a chance to start or complete all desired servicing operations. In such cases, the technician may have to awkwardly hold a flashlight with one hand while trying to manipulate tightly packed machine parts with the other. It would be helpful if the technician had use of both hands even after the gaming machine circuits have cut off power to the internal service lights so that the technician can more easily and more quickly complete the needed servicing operations.

It is to be understood that some concepts, ideas and problem recognitions provided in this description of the Background may be novel rather than part of the prior art.

SUMMARY

A gaming machine is provided having a cabinet with one or more technician accessible and normally locked compartments that include respective compartment service lights. A respective gaming power supply node is provided in at least one of the compartments where power is supplied to that node for a limited time during servicing. In order to allow for long durations of service lighting in the compartment, a service backup battery is added to the compartment. A power selecting circuit is employed to automatically select either the service backup battery or the gaming power supply node for supplying power to service lights in the compartment.

A service lighting continuation apparatus is provided within a normally secured gaming machine having one or more technician accessible and normally locked compartments that include respective service lights. The service lighting continuation apparatus comprises: a service backup battery; a power sources interface circuit configured to receive backup power from the service backup battery and to receive primary power from a gaming machine power node, the power sources interface circuit operating to couple at least one of the received voltages of the gaming machine power node and the service backup battery to a power providing node of the power sources interface circuit; a first switch operable to detect a doorway open condition for a corresponding one of the normally locked compartments; and a second switch operable to couple power from the power providing node of the power sources interface circuit to the service lights of the corresponding compartment when the first switch indicates a door open condition for that compartment, the second switch being operable to discontinue its providing of power from the power providing node to the to the service lights when the first switch indicates at least one of a doorway closed and/or door locked condition.

A service lighting continuation method used with a normally secured gaming machine having one or more technician accessible and normally locked compartments that include respective compartment service lights, the method comprising: automatically supplying to a service power supplying node in a respective compartment, power from one or another of a gaming machine power supply node (GP) and a service backup battery (BP); automatically detecting if at least one of a compartment unlocked and compartment doorway open condition is true; and concurrently with detecting that at least one of the compartment unlocked and compartment doorway open condition is true, automatically coupling an otherwise not so coupled service light to the service power supplying node; and concurrently with detecting that at least the second of the compartment unlocked and compartment door open condition is false, automatically decoupling the service power supplying node from the service light.

Further aspects of the present disclosure of invention may be found in the following detailed descriptions.

BRIEF DESCRIPTION OF DRAWINGS

The present disclosure may be better understood by reference to the following detailed description taken in conjunction with the accompanying drawings, which illustrate particular embodiments in accordance with the present disclosure of invention.

DETAILED DESCRIPTION

Reference will now be made in detail to some specific embodiments in accordance with the present disclosure of invention. While the present disclosure is described in conjunction with these specific embodiments, it will be understood that it is not intended to limit the teachings of the present disclosure to the described embodiments. On the contrary, it is intended to cover alternatives, modifications, and equivalents as may be included within the spirit and scope of the teachings of the present disclosure.

In the following description, numerous specific details are set forth in order to provide a thorough understanding of the present disclosure. Particular embodiments may be implemented without some or all of these specific details. In other instances, well known process operations have not been described in detail in order not to unnecessarily obscure the present disclosure of invention. Although not explicitly shown in many of the diagrams, it is to be understood that the various automated mechanisms discussed herein typically include at least one digital data processing unit such as a central processing unit (CPU) where multicore and other parallel processing architectures may additionally or alternatively be used. The components are not limited to digital electronic ones and may include analog and/or mechanical and optical ones, including more particularly; high intensity light sources. Some of these components may generate concentrated amounts of local heat when operating and may have finned heat sinks and/or miniature cooling fans attached to them for maintaining predetermined acceptable operating temperatures. Some of these components may be securely enclosed within a series of the security enclosures for example, a locked box within a locked cabinet. It is to be further understood that the various automated mechanisms mentioned herein typically include or are operatively coupled to different kinds of non-transient data storage mechanisms including high speed caches (which could be on-chip, package secured caches), high speed DRAM and/or SRAM, nonvolatile Flash or other such nonvolatile random access and/or sequential access storage devices, magnetic, optical and/or magneto-optical storage devices (e.g., with motor-driven rotating media) and so on. The various data processing mechanisms and data storage mechanisms may be operatively intercoupled by way of local buses and/or other communication fabrics where the latter may include wireless as well as wired communication fabrics.

Figure 1:
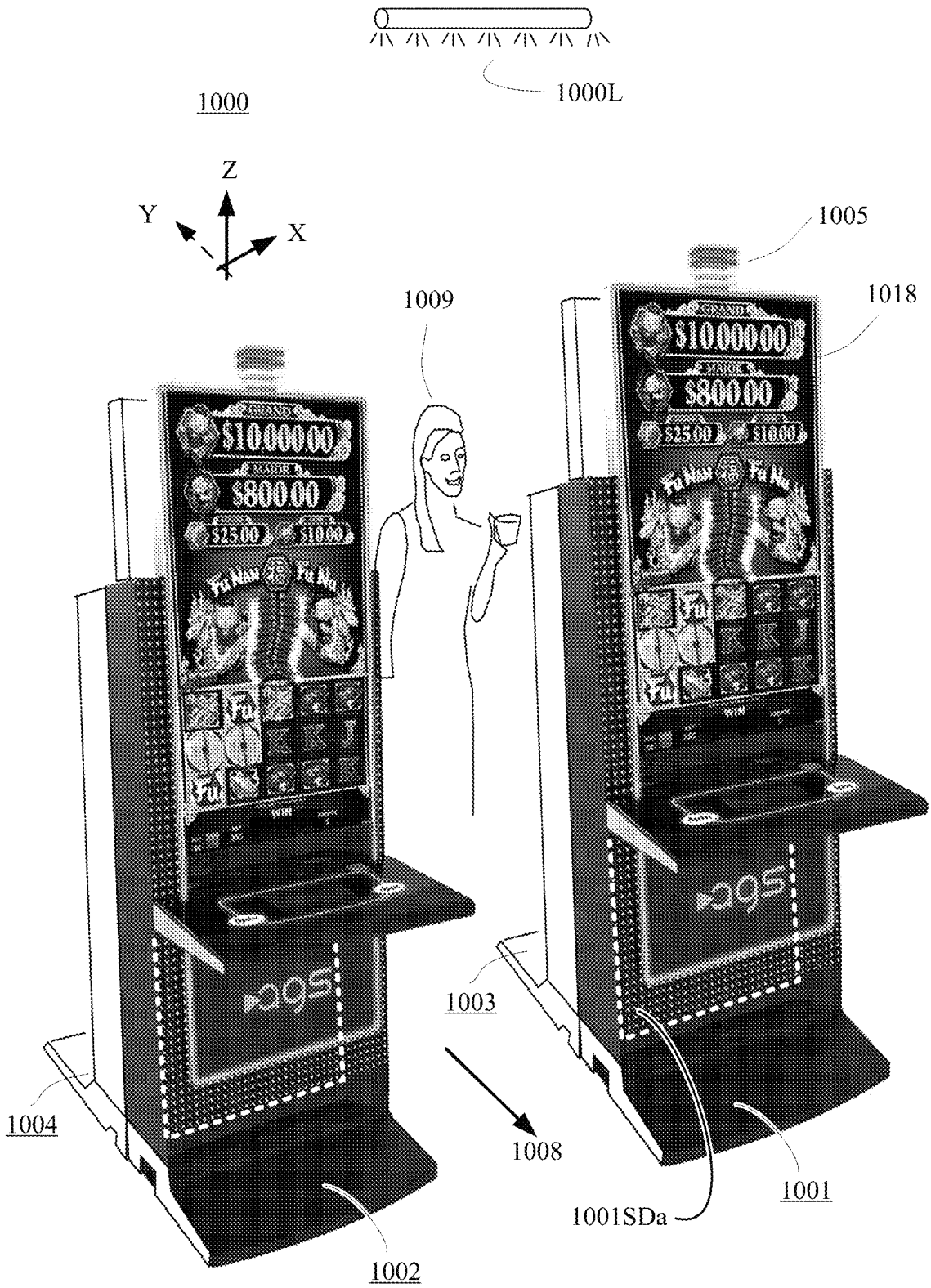
FIG. 1 illustrates a gaming system and environment including wager-based gaming machines in accordance with the present disclosure.

Referring to FIG. 1, a gaming environment 1000 in accordance with the present disclosure is described. The environment 1000 (e.g., a casino) may have a specific floor plan in which a plurality of gaming machines (e.g., slot machines 1001, 1002, 1003, 1004) are arranged close to one another in the form of back-to-back kiosks and/or side-by-side rows. Each machine may have a frontal display 1018 that flashes at times for attracting casino patrons (e.g., 1009) to it and a top-of-box candlelight unit 1005 for signaling when servicing at that specific machine may be required. Typically, overhead lighting 1000L in the environment is relatively dim as compared to customer attracting light sources (e.g., display 1018).

Servicing may be signaled for by the candlelight unit 1005 for any of a variety of reasons. A casino patron may have a question, may have difficulty with operating some of the machine's user buttons, and sometimes, the machine has internal problems (e.g., a ticket jam) that require the servicing technician to unlock and open one or more service doorways, for example a hidden lower service door (e.g., 1001SDa) for accessing components inside that part of the gaming machine (e.g., 1001). As mentioned above, when access to secured internal portions of the normally locked cabinet is detected by internal gaming control circuits, the gaming machine will typically automatically power itself down after having saved crucial data to nonvolatile secured memory. Technician accessible secured portions of the machine into which service technicians sometimes need to gain access (e.g., that behind hidden lower service door 1001SDa) often include an interior service light for allowing the technician to see into the cabinet portion despite the dim overhead lighting 1000L and the limited door access area of the respective cabinet portion. In some cases the internal gaming control circuits of the machine shut off power to all parts of the machine, including to the interior service lights before the technician has had a chance to start or to complete all desired servicing operations. In such cases, the technician may have to awkwardly hold a flashlight with one hand while trying to manipulate tightly packed machine parts with the other. It would be helpful if the technician had use of both hands even after the gaming machine circuits have cut off power to the interior service lights so that the technician can more easily and more quickly complete the needed servicing operations.

A problem associated with no longer having an operational cabinet interior service light (e.g., after 30 minutes of elapsed time) while more servicing is desired can be better understood by considering the environment 1000 in which the technician has to operate. In addition to the dim overhead ceiling lights (e.g., 1000L) and possibly distracting illuminations from surrounding other machines (e.g., 1002), the being serviced gaming machine (e.g., 1001) may have a player's desk projection (at the bottom of gaming display 1018) and/or other projections that can overshadow the accessed service door (e.g., 1001SDa) thus making need for an operative interior service light all the more desired. With the technician (not shown) sprawled across the floor, certain patron passageways such as the illustrated 1008 may be blocked and this may impede the flow of traffic by casino patrons to gaming machines in the vicinity of the one (e.g., 1001) being serviced. It would be advantageous to both the technician and the casino if the cabinet interior service light remained operational even in cases where the predetermined shutdown duration (e.g., 30 minutes) has expired, all normal power has been cut off and the technician still needs to continue working on the inside of the accessed cabinet portion (e.g., that accessed by way of the hidden under-desk door 1001SDa of FIG. 1).

The present disclosure provides for service lighting continuation for gaming cabinets even after the gaming machine control unit (e.g., within 210 of FIG. 2A) has shut off its provision of power to an internally accessible (and not-forbidden to be connected to) power node (e.g., GP node 221 of FIG. 2A) or has run out of power to provide to that node (GP 221).

Figure 2A:
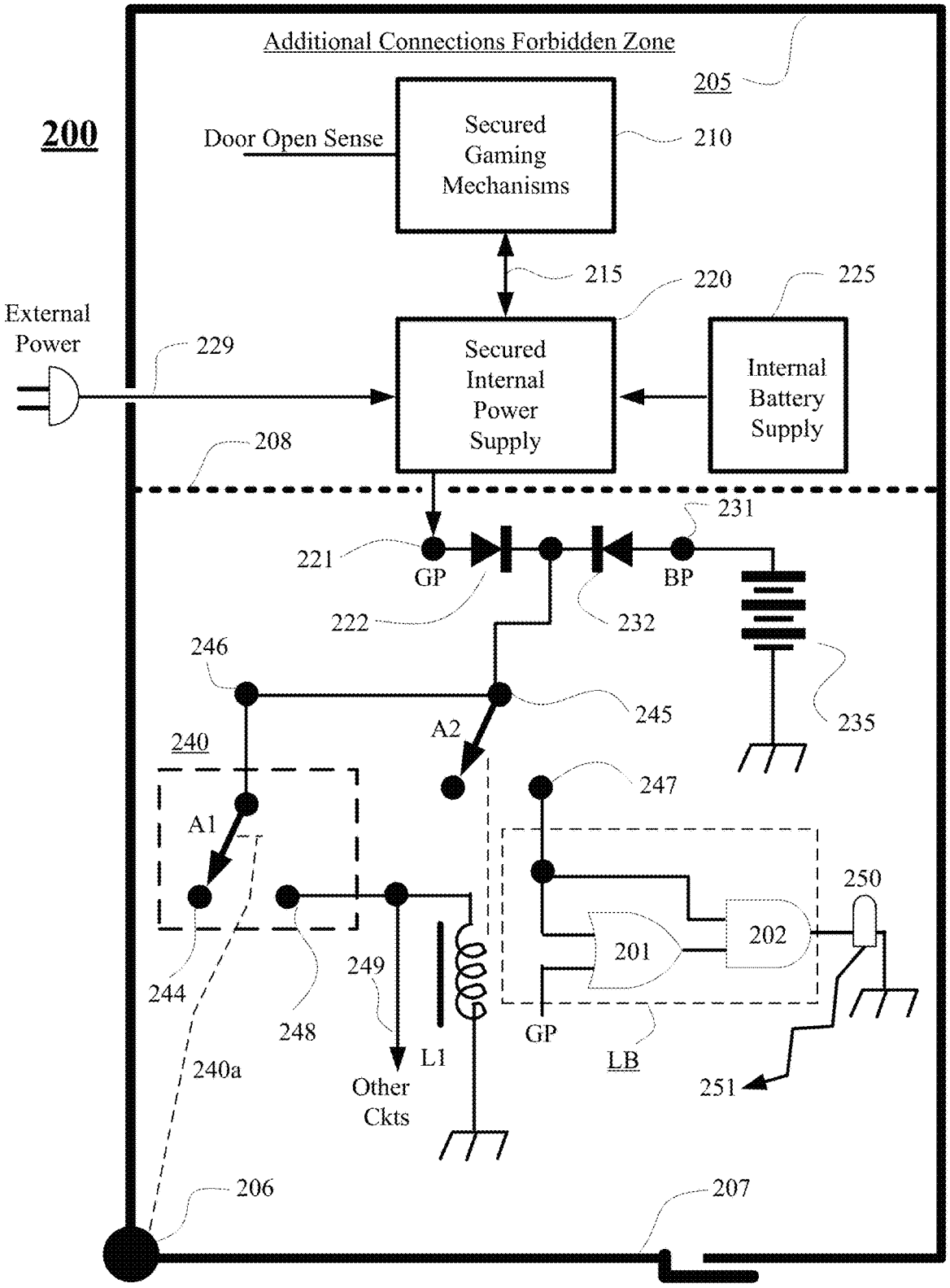
FIG. 2A illustrates a first service lighting continuation arrangement in accordance with the present disclosure.

FIG. 2A illustrates a first specific embodiment 200 of part of an automated wager-based gaming machine (e.g., a slot machine such as 1001 of FIG. 1). The illustrated first embodiment 200 includes a securely lockable cabinet and or other such housing 205 that includes a lockable access door 207 that allows for technician access to internal parts of the housing 205 for example by swinging the door open about hinge mechanism 206 or otherwise opening an access doorway (e.g., removing a lid). The hinge mechanism 206 (and/or optionally other parts of the access providing arrangement) is/are operatively coupled to one or more sensors including for example to electrical switch 240. The switch 240 (or an otherwise equivalent sensing mechanism) is configured to sense a doorway open condition (and/or door unlocked condition) and report the same to electrical sensing devices (e.g., to secured gaming and game control mechanisms 210). In conventional gaming machines (not shown), the door open sensing switch (corresponding to illustrated electrical switch 240) includes a terminal (not shown) that connects directly at one end to a service light source such as 250 and an additional terminal (not shown) that connects to the accessible gaming system power terminal 221 (also denoted as GP, could be a wire rather than a fixed terminal per se) such that when a door open condition occurs and power is still present at the provided gaming system power terminal 221 (GP), the service light source 250 will produce light 251 for adequately illuminating the interior of the accessed cabinet portion (e.g., 205) so that the technician can see into the illuminated portion and service it.

Dashed line 208 schematically represents the lower boundary of an additional-connections-forbidden zone above which it is not permitted to electrically connect to portions of the machine system that otherwise power and/or control operations of the gaming machine. More specifically, these other parts in the forbidden zone (schematically above line 208) may include secured gaming and gaming control mechanisms 210 which internally include secured data processing units, power-hit tolerant data storage units, security violation detecting circuits and other to-be-secured devices. The other parts in the forbidden zone may further include one or more secured internal power supplies 220 and one or more internal uninterruptible power supply units (UPS) 225 (e.g., a secured battery supply). The internal power supplies 220 are generally powered from an external power supply 229 (e.g., an AC power source). Link 215 allows the secured gaming and gaming control mechanisms 210 to control the internal power supplies 220 and the internal UPS 225. If an interruption to the external power supply 229 is detected by the secured gaming and gaming control mechanisms 210, they will automatically activate the internal UPS 225 and enter into a security maintaining power down procedure where crucial wager-based and other data are automatically stored into the power-hit tolerant data storage units (not individually shown, understood to be inside block 210). The secured gaming and gaming control mechanisms 210 will typically also activate various alarms including a top of box, technician calling candlelight unit (e.g., 1005 of FIG. 1) for summoning a service technician to the gaming machine and then proceed with an orderly powering down procedure. The powering down procedure may continue to supply electrical power by way of the exposed not-forbidden GP terminal 221 for keeping the service light available for a predetermined limited amount of time (e.g., 30 minutes, but could be a different predetermined duration). However, eventually that GP power supply node 221 runs out of power or is intentionally shut off for other reasons and the conventional service light 250 can no longer provide illumination 251 to the cabinet internals. The technician is left to work in the dark or to supply external lighting by way of a handheld flashlight for example. Neither of these are attractive options.

In the first depicted embodiment 200 of FIG. 2A, a number of additional components are introduced into the non-forbidden zone below schematic line 208. These additional components include an added service backup battery 235, first and second diodes 222 and 232, a normally open (N/O) magnetic relay L1 wired as schematically shown in combination with the door open sensing switch 240 and a logic block LB that may contain few logic gates (e.g., 201-202). Operation of this added-in circuitry is as follows. Node 245 receives the GP voltage (if any is present) from the not-forbidden power node 221 by way of first diode 222 and receives the backup battery voltage BP from node 231 by way of second diode 232. In one embodiment, battery 235 is a non-rechargeable primary battery. In an alternate embodiment, battery 235 is a rechargeable secondary battery. In one embodiment, a trickle current resistor is added in parallel to second diode 232 to allow the GP supply to trickle charge the service backup battery 235 over time.

The voltage provided at node 245 (and also at connected node 246) is supplied to a first armature A1 within door switch 240 and to a second armature A2 of the added and normally open (N/O) relay that further includes actuation coil L1. The first armature A1 is in the illustrated open circuit state when its corresponding and lockable access door 207 is in the closed and optionally also locked state. An appropriate actuation coupling 240*a* (e.g., mechanical, magnetic, fluidic, etc.) is provided between door 207 (and/or its security lock mechanism—not shown) and the first armature A1 so that when the door is opened (or in one embodiment, at least unlocked) this armature A1 switches from contacting optional open circuit terminal 244 to making contact with its circuit closing terminal 248 thereby connecting node 246 to the activation coil L1 of the N/O relay and thus applying the voltage present at node 245 to coil L1.

In one embodiment, the actuation coil L1 of the N/O relay (and associated resilient member (e.g., spring—not shown) is designed to switch the state of its corresponding armature A2 from the normally open state to making contact with terminal 247 if a voltage above a predetermined threshold (e.g., +3V) is applied to the actuation coil L1. Thus, if no voltage or a below-threshold voltage is applied to the actuation coil L1 the second armature A2 will remain in its normally open state. On the other hand, if node 246 provides an above-threshold voltage and the access door 207 is open (thereby causing first armature A1 to make contact with circuit closing terminal 248), voltage is supplied by way of terminal 247 to logic block LB (e.g., one embodiment of which is comprised of OR gate 201 and AND gate 202). The logic block LB drives one or more service light producing devices 250 when appropriate conditions are met (e.g., door 207 is open and sufficient voltage is present to drive light 250) where the latter service light producing devices 250 then generate illumination 251 for appropriately lighting up the interior of the accessed portion of the housing 205 and for thereby allowing a service technician to see inside irrespective of whether the internal power supply 220 is still supplying power to accessible node 221. It is to be understood that the illustrated internal components of logic block LB and the input signals shown to be applied thereto are merely exemplary and that many other configurations are possible. In more general terms the depicted embodiment of FIG. 2A is understood to test for satisfaction of a number of conditions including determining whether the service doorway is open or at least unlocked before activating the service light(s) 250.

When the service technician closes access door 207, the first armature A1 switches back to its normally open state (to position 244 which may or may not have its own terminal), the above-threshold voltage is then no longer applied to relay actuation coil L1, the second armature A2 then returns to its normally open state (no longer contacting terminal 247) and the service light source or sources 250 then shut off. In one embodiment, an optional line 249 is provided for powering other below-line-208 circuits.

Figure 2B:
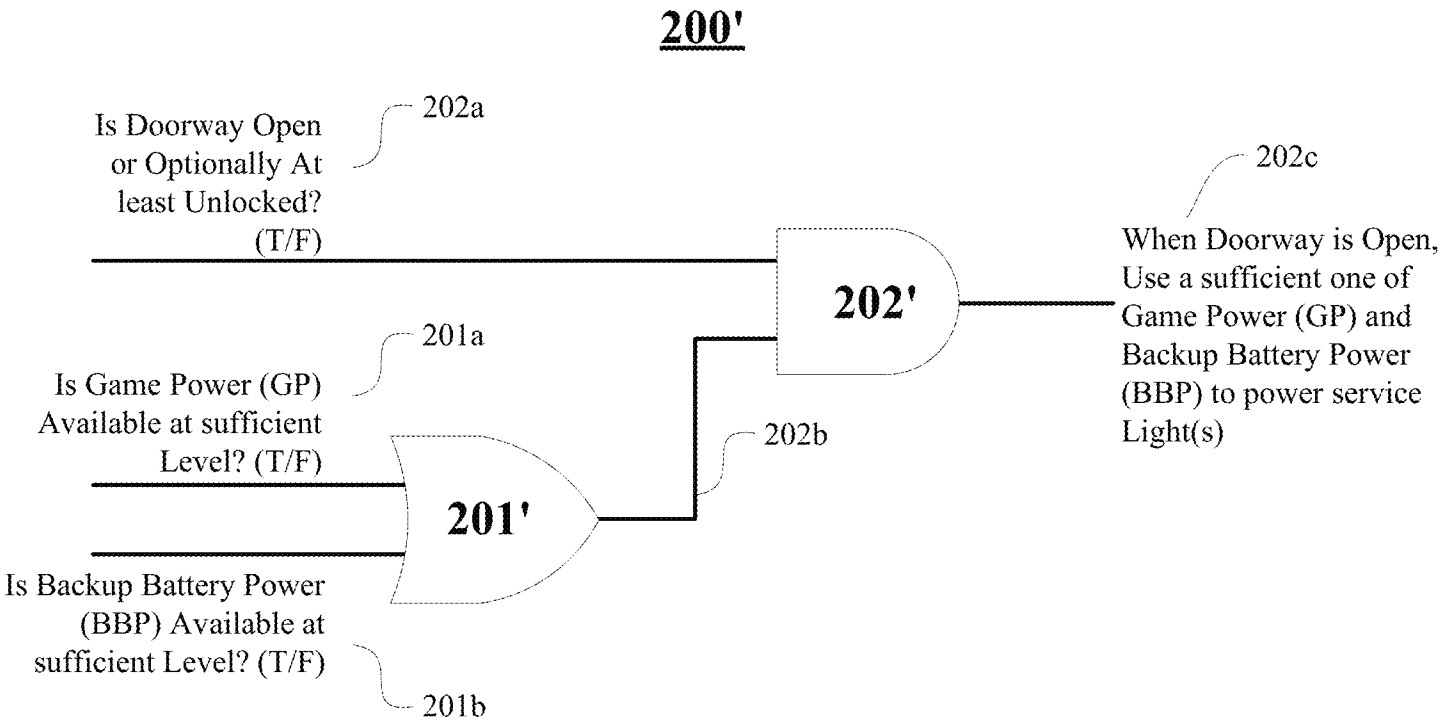
FIG. 2B depicts logic for carrying out a service lighting continuation method in accordance with the present disclosure.

Referring to FIG. 2B, shown is a modified schematic depiction of logic 200 (FIG. 2A) which use logic gates as a decision circuitry means for carrying out a service lighting continuation method in accordance with the present disclosure. The decision circuitry means may come in many forms aside from logic gates including for example a microcontroller (not shown) programmed to decide whether and when to apply power to the service lights and when to discontinue such application based on a variety of input conditions where the microcontroller draws its power from one or both of the GP and BP power nodes when sufficient power is available from those power nodes and where the microcontroller and/or associated output interface circuitry defaults to shutting off the interior service lights when there is insufficient power. In one embodiment, the illustrated and merely exemplary logic 200' of FIG. 2B may receive input signals different than those provided to logic block LB in FIG. 2A. The logic input signals may be developed by various analog to digital signal conversion techniques (A/D) including for example, voltage level shifting. In FIG. 2B, a first determination 202*a* is automatically made as to whether the doorway of a given serviceable compartment in the gaming machine is open or optionally at least unlocked (True/False). A second determination 201*a* is automatically made as to whether an accessible Game Power node (GP—see also FIG. 2C) can provide power at predetermined minimum or sufficient level to power the service lights (T/F). A third determination 201*b* is automatically made as to whether a provided service backup battery (BP—see also FIG. 2C) is charged such that it can provide power at predetermined minimum or sufficient level to power the service lights (T/F). A logic OR (201') operation is automatically performed for the second and third determinations. A logic AND (202') operation is automatically performed for the first determination 202*a* and the result 202*b* of the OR operation 201'. The result 202*c* of the AND operation 202' indicates when the doorway is open (or optionally in one embodiment, at least unlocked) and there is sufficient power available from at least one of the Game Power node (GP) and a Backup Battery Power node (BP) to power a corresponding one or more service lights. If yes (if 202*c* is True), the schematically represented logic method 200' picks and uses a sufficient one of the Game Power (GP) and the Backup Battery Power (BBP) to power the corresponding service lights. In one embodiment, the more powerful one (e.g., the one having the larger voltage) of GP and BP is automatically selected. Although not shown in FIG. 2B, a voltage discriminating analog circuit (e.g., D2 and D3 of FIG. 3A) may optionally be used to automatically pick the more powerful power source.

Operation of the logic depicted in FIG. 2B may be summarized by the following truth table:

| Row | GP ≥ Th | BP ≥ Th | Door = Open | Lights On |
|---|---|---|---|---|
| A | 0 | 0 | 0 | 0 |
| B | 1 | 0 | 0 | 0 |
| C | 0 | 1 | 0 | 0 |
| D | 1 | 1 | 0 | 0 |
| E | 1 | 1 | 1 | 1 |
| F | 0 | 1 | 1 | 1 |
| G | 1 | 0 | 1 | 1 |
| H | 0 | 0 | 1 | 0 |

The heading of the second column, GP≥Th represents the proposition that the voltage at the Game Power node GP is greater than or equal to a predetermined threshold. False is represented by a zero (0) the rows below it and True is represented by a one (1). As noted above, the corresponding logic input signals may be developed by various analog to digital signal conversion techniques (A/D) including for example, voltage level shifting. The output signal (Lights On) may be either a digital or analog signal (e.g., latter generated by a digital to analog signal conversion technique (D/A). The logic itself may be carried out using a ROM lookup table (LUT), a programmed data processor (e.g., CPU) or other digital signal processing means. Alternatively, the truth table may represent operations of circuitry that is substantially analog in nature (see for example FIG. 3A). The heading of the third column, BP≥Th represents the proposition that the voltage at the battery power node BP node is greater than or equal to the predetermined threshold. In one embodiment, the predetermined threshold Th is a minimum voltage level deemed necessary to drive the service light(s). Once again, 0 means False and 1 means True. The heading of the fourth column, Door=Open represents the proposition that the door switch is indicating a doorway open condition. Once more, 0 means False and 1 means True. The heading of the fifth column, Lights On represents the conclusion that the service lights should be connected so as to be driven by at least one of the GP and BP voltages. Here, the rows below the heading, 0 means No and 1 means Yes. As seen in rows E-G, the lights are to be turned on when Door=Open is True and at least one of GP and BP is at or above the predetermined threshold Th. While the logic gates shown in FIG. 2B can implement this function, it is to be understood that other forms of logic may be used, including for example a memory acting as a LookUp Table (LUT) where the address lines are inputs and the stored bits act as the output. The LUT may have additional inputs and/or outputs if desired. For example, in one embodiment, a further requirement for lighting the service lights might be that security software has pre-authorized such illumination.

Figure 2C:
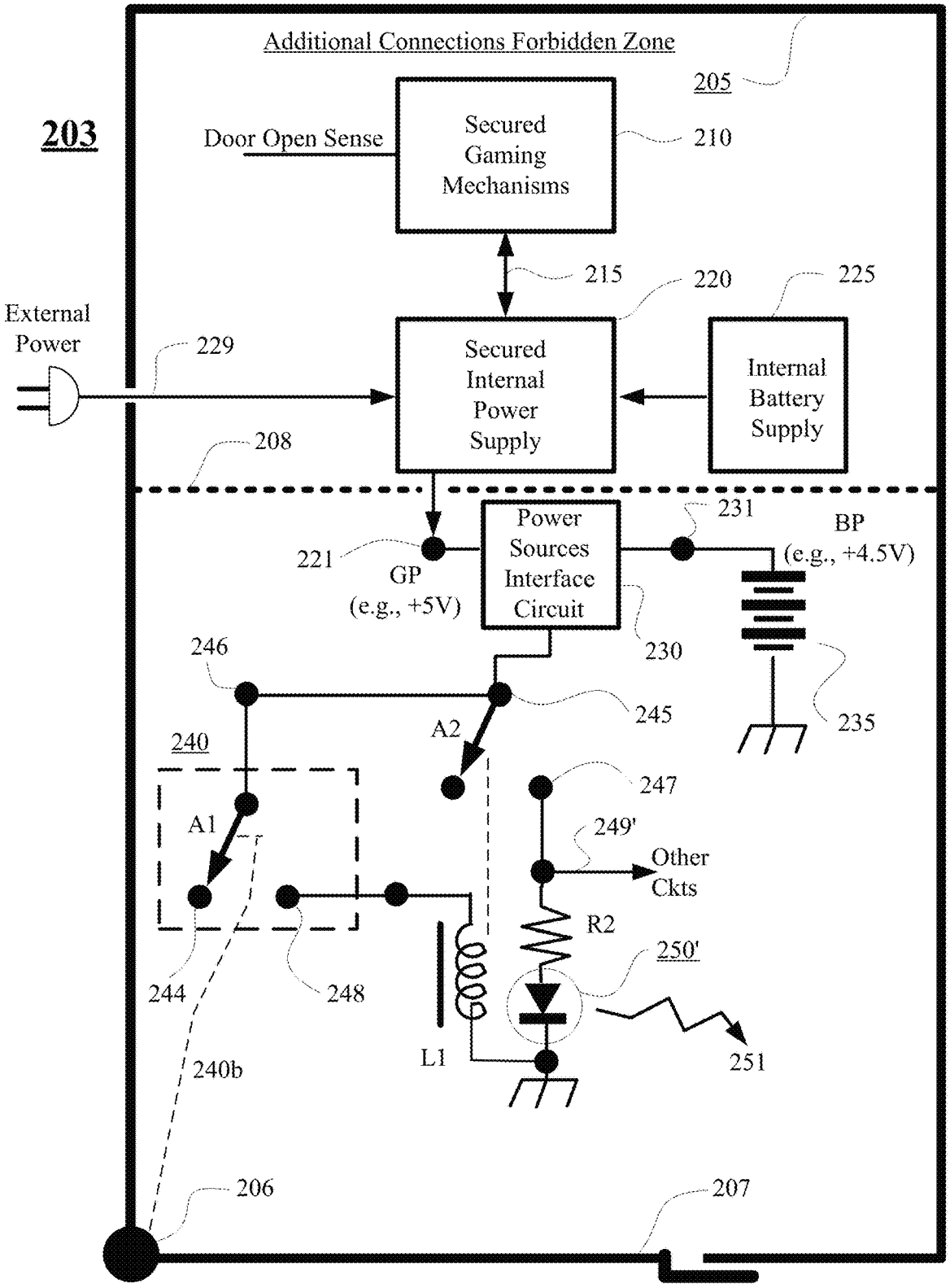
FIG. 2C illustrates a second service lighting continuation arrangement in accordance with the present disclosure.

Referring to FIG. 2C, shown is a schematic depiction of a second specific embodiment 203 of part of an automated wager-based gaming machine (e.g., a slot machine such as 1001 of FIG. 1). The illustrated second embodiment 203 includes a securely lockable cabinet and or other such housing 205 that includes a lockable access door 207 that allows for technician access to internal parts of the housing 205 for example by swinging the door open about hinge mechanism 206. The hinge mechanism 206 (and/or optionally other parts of the access arrangement) is operatively coupled to a sensor such as electrical switch 240 where the switch 240 (or an otherwise equivalent sensing mechanism) is configured to sense a doorway open condition (and/or door unlocked condition) and report the same to electrical sensing devices (e.g., to secured gaming and game control mechanisms 210). In conventional gaming machines (not shown), the door open sensing switch (corresponding to illustrated electrical switch 240) includes a terminal (not shown) that connects directly at one end to a service light source such as 250 and an additional terminal (not shown) that connects to a gaming system power terminal 221 (e.g., the GP +5V node) such that when a door open condition occurs and power is still present at the provided gaming system power terminal 221 (GP), the service light source 250 will produce light 251 for adequately illuminating the interior of the accessed cabinet portion (e.g., 205) so that the technician can see into the illuminated portion and service it.

In the depicted second embodiment 203 of FIG. 2C, a few additional components are introduced into the non-forbidden zone below schematic line 208. These additional components include an added backup battery 235, a power sources interface circuit 230 and a normally open (N/O) magnetic relay L1 wired as schematically shown in combination with the door open sensing switch 240. Operation of this added-in circuitry is as follows. The power sources interface circuit 230 receives the GP voltage (if any is present) from the not-forbidden power node 221 and receives the backup battery voltage BP from node 231. The power sources interface circuit 230 couples at least one of the received voltages (or optionally, a different voltage derived from one of the GP voltage and the BP voltage) to its power providing output node 245. In one embodiment, the larger of the two received voltages, GP and BP (if either is at least greater than zero), is used as a power source for supplying an adequate voltage to output node 245. In one embodiment, battery 235 is a non-rechargeable primary battery. In an alternate embodiment, battery 235 is a rechargeable secondary battery. In the latter case, the power sources interface circuit 230 optionally includes a trickle charging portion (not explicitly shown in FIG. 2C, see D1 of FIG. 3A) configured to use the GP voltage of node 221 as a power source for trickle charging the rechargeable secondary battery. In an embodiment, battery 235 is selected to have a slightly lower fully charged voltage than that of the GP voltage at node 221. For example, if the GP voltage is set at +5V then the fully charged voltage of battery 235 may be approximately +4.5V. Other voltage configurations (e.g., GP=+13V, BP=+12V) are of course possible depending on the chosen electrochemistry of the battery 235, the number of series-connected cells in the battery and the set GP voltage value at node 221 when internal power supply 220 is providing that GP voltage. It is within the contemplation of the present disclosure that the power sources interface circuit 230 includes a voltage boosting circuit (not shown) configured to boost the voltage of the backup battery 235 to a predetermined adequate level that is then selectively applied to node 245 (e.g., if GP is not adequate) for driving the service light source(s) 250.

Irrespective of the specific characteristics of backup battery 235, the battery is picked to comply with respective laws, rules and security concerns if any for placing such a battery within housing 205 (and in the non-forbidden zone below boundary 208). More specifically, the battery 235 should be appropriately sealed and configured for safe operation so as not to outgas or otherwise expel harmful chemicals into the environment of the locked housing 205 for all the expected operating temperatures, pressures or other environmental conditions that can develop inside the housing 205. The battery 235 should also be configured to avoid overheating, catching fire or otherwise endangering the other components found within lockable housing 205.

The interface supplied voltage provided at node 245 (and also at connected node 246) is supplied to a first armature A1 within door switch 240 and to a second armature A2 of the normally open (N/O) relay that further includes actuation coil L1. The first armature A1 is in the illustrated open circuit state when its corresponding and lockable access door 207 is in the closed and optionally also locked state. An appropriate actuation coupling 240*a* (e.g., mechanical, magnetic, fluidic, etc.) is provided between door 207 (and/or its security lock mechanism—not shown) and the first armature A1 so that when the door is opened (or in one embodiment, at least unlocked) this armature A1 switches from contacting optional open circuit terminal 244 to making contact with its circuit closing terminal 248 thereby connecting node 246 to the activation coil L1 of the N/O relay and thus applying the voltage output by the power sources interface circuit 230 at node 245 to coil L1.

In one embodiment, the actuation coil L1 of the N/O relay (and associated resilient member (e.g., spring—not shown) is designed to switch the state of its corresponding armature A2 from the normally open state to making contact with terminal 247 if a voltage above a predetermined threshold (e.g., +3V) is applied to the actuation coil L1. Thus, if no voltage or a below-threshold voltage is applied to the actuation coil L1 the second armature A2 will remain in its normally open state. On the other hand, if the power sources interface circuit 232 outputs an above-threshold voltage and the access door 207 is open (thereby causing first armature A1 to make contact with circuit closing terminal 248), power is supplied by way of terminal 247 to one or more service light producing devices 250 where the latter then generate illumination 251 for appropriately lighting up the interior of the accessed portion of the housing 205 and for thereby allowing a service technician to see inside irrespective of whether the internal power supply 220 is still supplying power to accessible node 221.

When the service technician closes access door 207, the first armature A1 switches back to its normally open state (to position 244 which may or may not have its own terminal), the above-threshold voltage is then no longer applied to relay actuation coil L1, the second armature A2 then returns to its normally open state (no longer contacting terminal 247) and the service light source or sources 250 then shut off. In one embodiment, an optional line 249 is provided for powering other below-line-208 circuits in similar fashion to the way the service light source or sources 250 are powered.

It is to be understood that although service light source 250 is schematically illustrated as a single light emitting diode (LED) in series with a current limiting resistor R2, many other configurations are possible. The service light source 250 may be comprised of a plurality of series-connected LEDs and/or parallel-connected LEDs and/or other forms of light sourcing that are distributed about the technician accessible interior portions of the housing 205. The individual LEDs may be configured to produce white light or combinations of differently colored LEDs (e.g., red, green, blue) may be used to provide the interior lighting. As noted, the LEDs implementation is a non-limiting example and any other practical forms of interior lighting may be alternatively or additionally used including incandescent, fluorescent, organic light panels and so on. Where appropriate, a voltage conversion stage (e.g., DC/DC step up) may be included to drive higher voltage interior lighting devices.

Figure 3A:
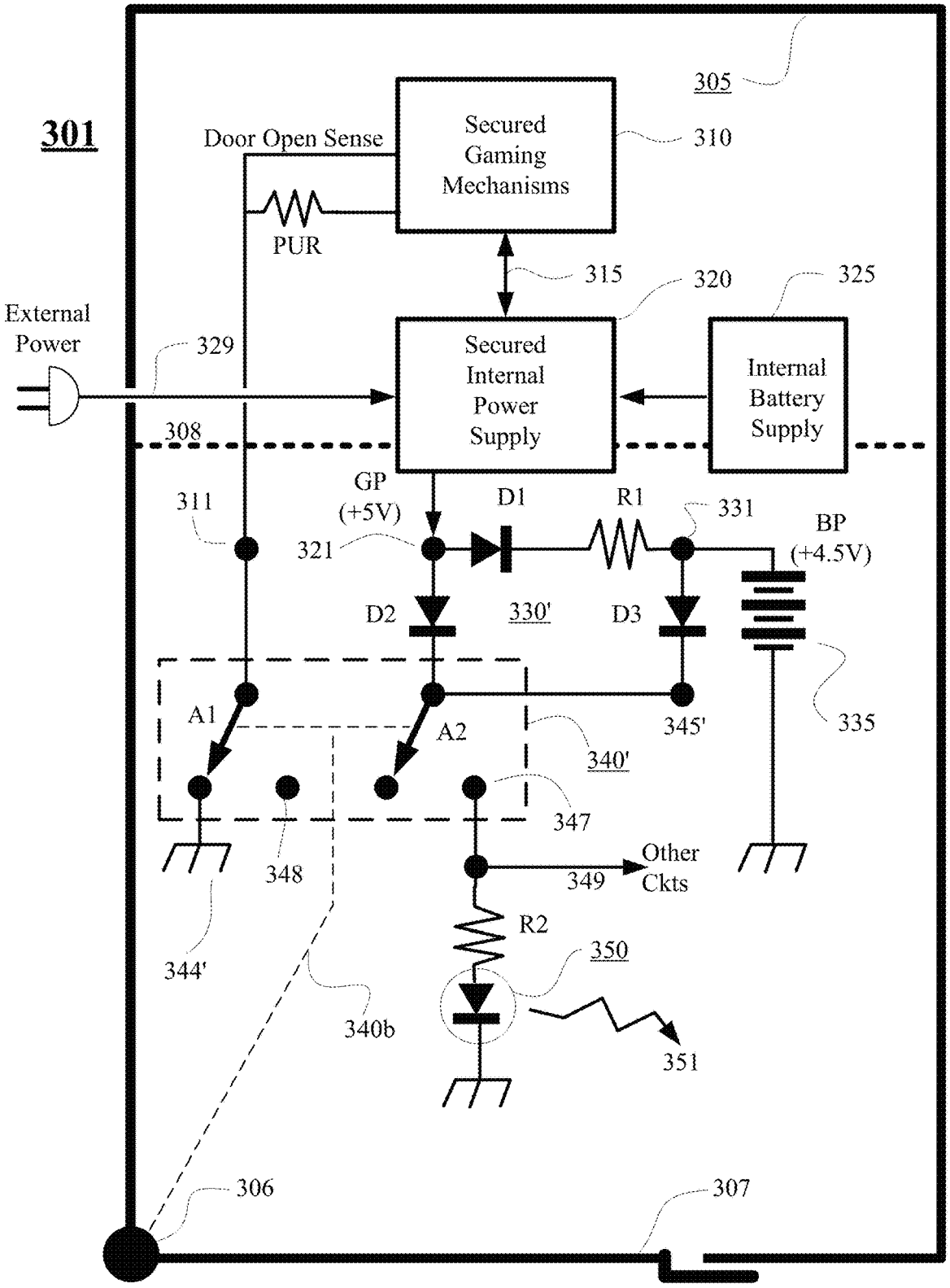
FIG. 3A illustrates a third service lighting continuation arrangement in accordance with the present disclosure.

Referring to FIG. 3A, shown is another embodiment 301 in which one set of possible specifics for the power sources interface circuit 330' are schematically illustrated. It is to be understood that like reference numbers in the 300 century range are used in FIGS. 3A-3C for elements having counterparts in FIG. 2C but denoted by reference numbers in the 200 century range. In the embodiment 301 of FIG. 3A, first armature A1 is part of a double pole double throw (DPDT) switch 340' which also includes second armature A2. When the access door 307 is opened (or at minimum unlocked for one embodiment), armature actuating mechanism 340*b* causes the first armature A1 to switch state and break contact with grounded terminal 344' while also causing the second armature A2 to switch state and make contact with light powering terminal 347. The secured gaming and gaming control mechanisms 310 include an internal pull-up resistor (PUR) which is shown externally thereof for sake of indicating that the voltage on the door open sensing line will switch from being grounded to being pulled high when the first armature A1 is switch to the open circuit state due to the access door 307 being opened (or unlocked). In one embodiment, one or more of the schematically illustrated groundings are chassis grounds where the chassis interior is understood to include a conductive metal.

The details of the illustrated power sources interface circuit 330' are as follows. A first diode D1 and current-limiting resistor R1 are optionally provided in series between node 321 and node 331 for trickle charging battery 335 if the latter is a rechargeable type and if such charging is desired. In that latter case, the service battery 335 is kept fully charged when the internal power supply 320 is operative to supply power at a greater voltage to the GP node 321 over relatively long periods of time. As a result, the service lighting backup battery 335 does not have to be replaced except when its rated battery life is exceeded.

A second diode D2 connects as illustrated from node 321 to node 345' while a third diode D3 connects as illustrated from node 331 to node 345' to thereby form an analog OR circuit which supplies the greater of the GP voltage (of node 321, e.g., +5V if powered up) and the backup battery voltage BP (of node 331, e.g., +4.5V if fully charged) to service power providing node 345'. The second and third diodes, D2 and D3 need not be silicon diodes. They can instead be formed as germanium diodes which have a lower forward bias voltage drop than silicon or as diode-connected field effect transistors (not shown) where the latter preferably have reduced threshold voltages for thereby enabling lower than normal source to drain drop voltages than the forward drop of silicon diodes. When the second armature A2 makes contact with light powering terminal 347 (due to access door 307 having been opened or optionally at least unlocked), power is applied to the service light source(s) 350 and the interior of the housing 305 is illuminated. When the service door closes again (and optionally is additionally locked), the second armature A2 breaks contact with light powering terminal 347 and power is no longer applied to the service light source(s) 350. At the same time the first armature A1 switches to remake contact with grounded terminal 344' and the door open sense line goes low, thereby indicating to the secured gaming and gaming security mechanisms 310 that the door has been closed (and optionally in one embodiment, additionally locked). If the door sensing mechanism 340*b* and 340 does not indicate locking of the door, other sensors (not shown) may be used to indicate whether or not the door 307 has been properly locked after being closed.

It is to be understood that although FIG. 3A depicts one exemplary way of implementing a power sources interface circuit (e.g., 330'), the teachings of the present disclosure are not limited to just the depicted implementation. More generally, the power sources interface circuit automatically determines if at least one of the GP and BP nodes can supply an adequate amount of power for appropriately powering the service light source(s) 250/350. In one embodiment, the power sources interface circuit automatically boosts a respective voltage present at at least one of the GP and BP nodes so that an adequate voltage will be presented at node 245/345' for appropriately powering the service light source(s) 250/350. In one embodiment, the power sources interface circuit automatically determines if the backup battery 235/335 is a rechargeable kind and/or if it needs recharging, and if so, it automatically obtains power from the GP node (at times that such power is determined to be available and not needed for driving the service lights) and uses the obtained power to appropriately trickle charge the backup battery. In one embodiment, the power sources interface circuit may couple to an externally viewable LED (not shown) and may automatically periodically flash that LED (e.g., a red/green LED) to indicate whether the current condition of the backup battery is good or it needs replacement. A service technician may occasionally walk the casino floor, scan the externally viewable LED's and thus verify that all backup batteries are in good condition (e.g., fully charged) and/or replace those that need replacement.

Figure 3B:
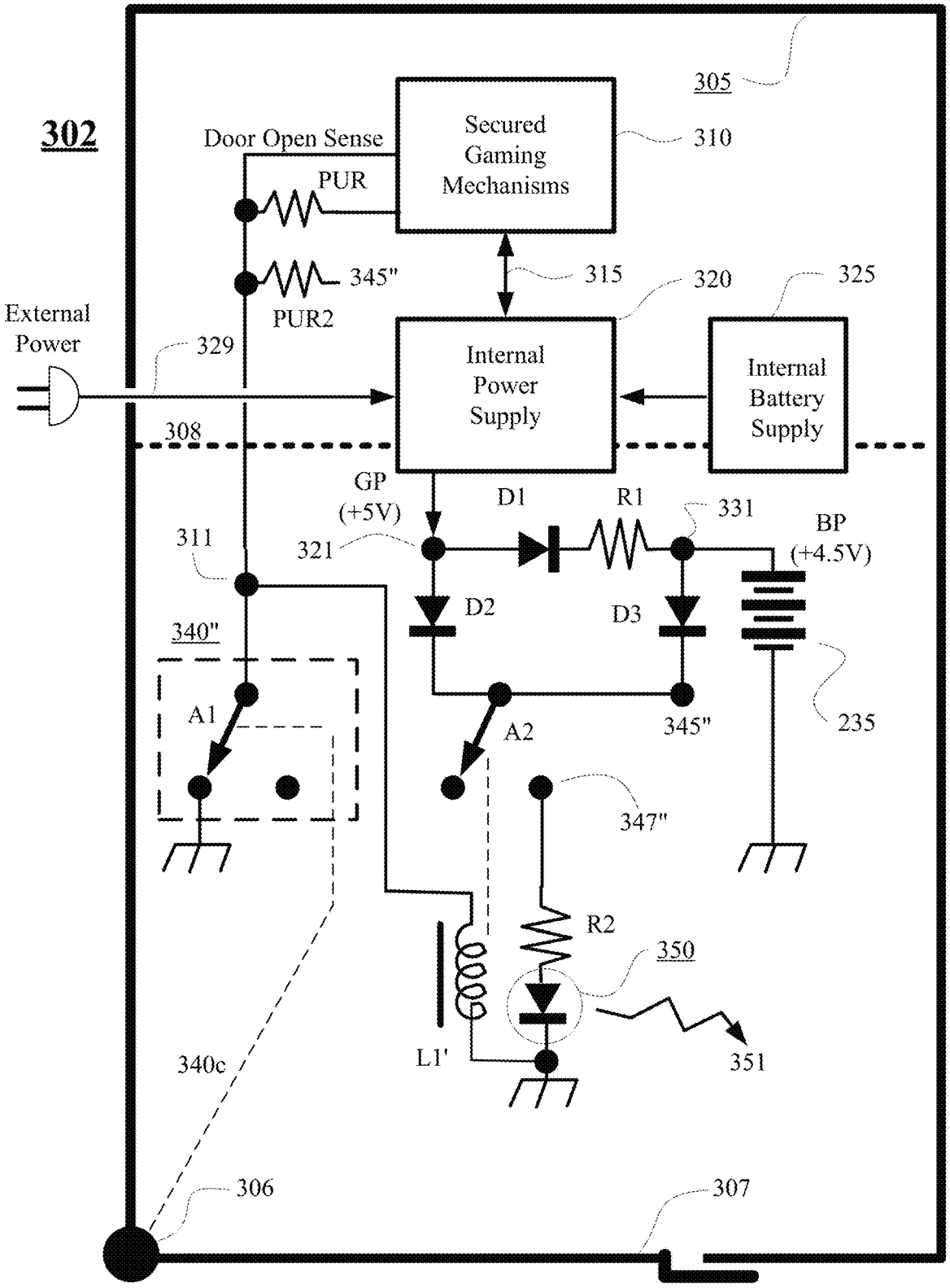
FIG. 3B illustrates a fourth service lighting continuation arrangement in accordance with the present disclosure.

Referring to FIG. 3B, shown is yet another embodiment 302 in which door sensing switch 340" is a single pole single throw (SPST) one that drives the door open sense line low when the door 307 is closed (and optionally in one embodiment, also locked). The door open sense line has a node 311 connecting to normally open (N/O) relay L1'. In addition to the already present pull-up resistor PUR, an extra pull-up resistor PUR2 is added (added within the not-forbidden zone although shown otherwise due to drawing space limitations) between the door open sense line and lighting power supplying node 345" to assure that and above-threshold voltage will be applied to the actuation coil L1' of the N/O relay even if the internal power supply 320 is not supplying power to the normal pull-up resistor PUR. When the first armature A1 disconnects from ground, at least one of pull-up resistors PUR and PUR2 supplies sufficient voltage and/or current to activate the relay coil L1' and cause the second armature A2 to make contact with power supplying terminal 347". As a result, the service light source(s) are turned on even if the internal power supply 320 is no longer supplying power to the GP node 321. When the door 307 closes, the first armature A1 reconnects with ground thus shorting out the relay coil L1' and causing the second armature A2 to break contact with power supplying terminal 347". As a result, the service light source(s) are turned off. At the same time, the door open sense line goes low again to indicate to the secured gaming and gaming control mechanisms 310 that the access door 307 is closed (and optionally also properly locked).

Figure 3C:
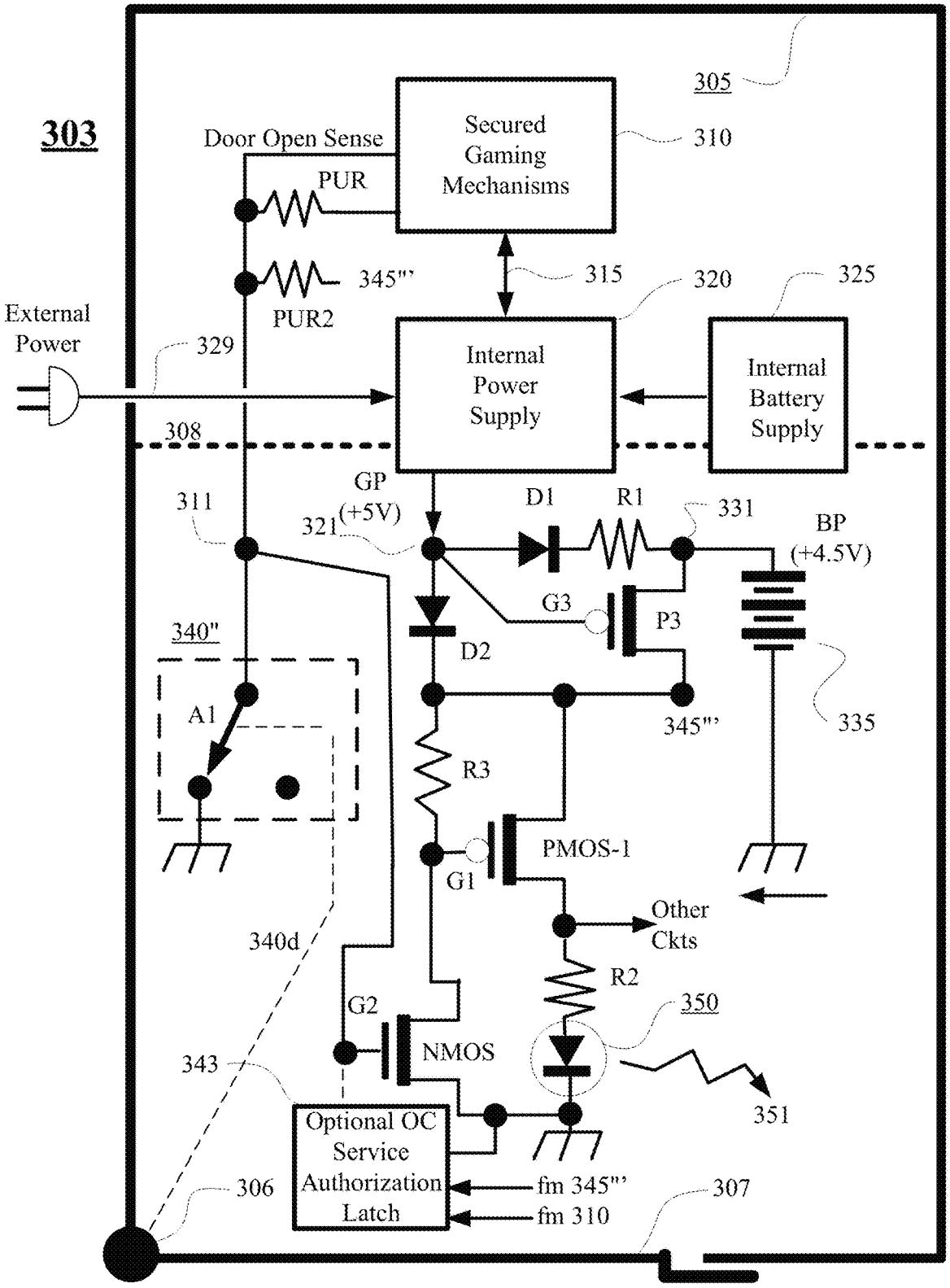
FIG. 3C illustrates a fifth service lighting continuation arrangement in accordance with the present disclosure.

Referring to FIG. 3C, shown is yet another embodiment 303 in which the third diode D3 is replaced by a PMOS transistor P3 having source and drain respectively coupled to nodes 331 and 345''' while the gate G3 of PMOS transistor P3 is connected to GP node 321. If the GP node is high then the PMOS transistor P3 will be turned off. On the other hand if the GP node is low (e.g., grounded) then the PMOS transistor P3 will be turned on so as to couple the service backup battery 335 to the service power providing node 345'''. Additionally in FIG. 3C, the mechanical relay of FIG. 3B is replaced with a solid state circuit composed of another PMOS transistor PMOS-1, a pull-up resistor R3 connected to the gate (G1) of PMOS-1 and an NMOS transistor coupled between G1 and ground. The respective gate (G2) of the NMOS transistor connects to node 311. The NMOS transistor and pull-up resistor R3 operate as an inverter for driving the gate (G1) of PMOS-1 high when the door is closed and low when the door 307 is open. Transistor PMOS-1 is turned on when G1 goes low and then supplies power to the service light source(s) 350 when the door is open. Transistor PMOS-1 is turned off to discontinue power to the service light source(s) 350 when the door is closed and G1 goes high again. Diode D2 will be reversed biased in the case where the GP voltage is lower than the battery backup voltage provided through the PMOS transistor P3.

In one embodiment, an optional open-collector output type service authorization latch 343 (e.g., an RS flip flop with an open-collector output driver) is provided with its open collector output connected to the gate G2 of the NMOS transistor. The open-collector type service authorization latch 343 receives power from node 345''' and a command signal from the secured gaming and gaming control mechanisms 310. If servicing of the compartment by a technician is not authorized, the command signal will set the OC output of the latch 343 to logic low, thereby grounding the gate G2 of the NMOS transistor and keeping the NMOS transistor turned off. As a result, the NMOS transistor is prevented from turning on the PMOS-1 transistor to provide power to the light source(s) 350 and the optional other circuits in the non-forbidden zone (below 308). On the other hand, if technician servicing is authorized for the corresponding compartment, the command signal from control mechanisms 310 will set the latch 343 high, thereby causing its OC output to float as opposed to being grounded. As a result, the NMOS transistor is not prevented by the OC latch 343 from turning on the PMOS-1 transistor to provide power to the light source(s) 350 and the optional other circuits in the non-forbidden zone (below 308). It is within the contemplation of the present disclosure to include yet other circuits powered by the voltage at node 345''' other than the exemplary authorization latch 343.

Figure 4:
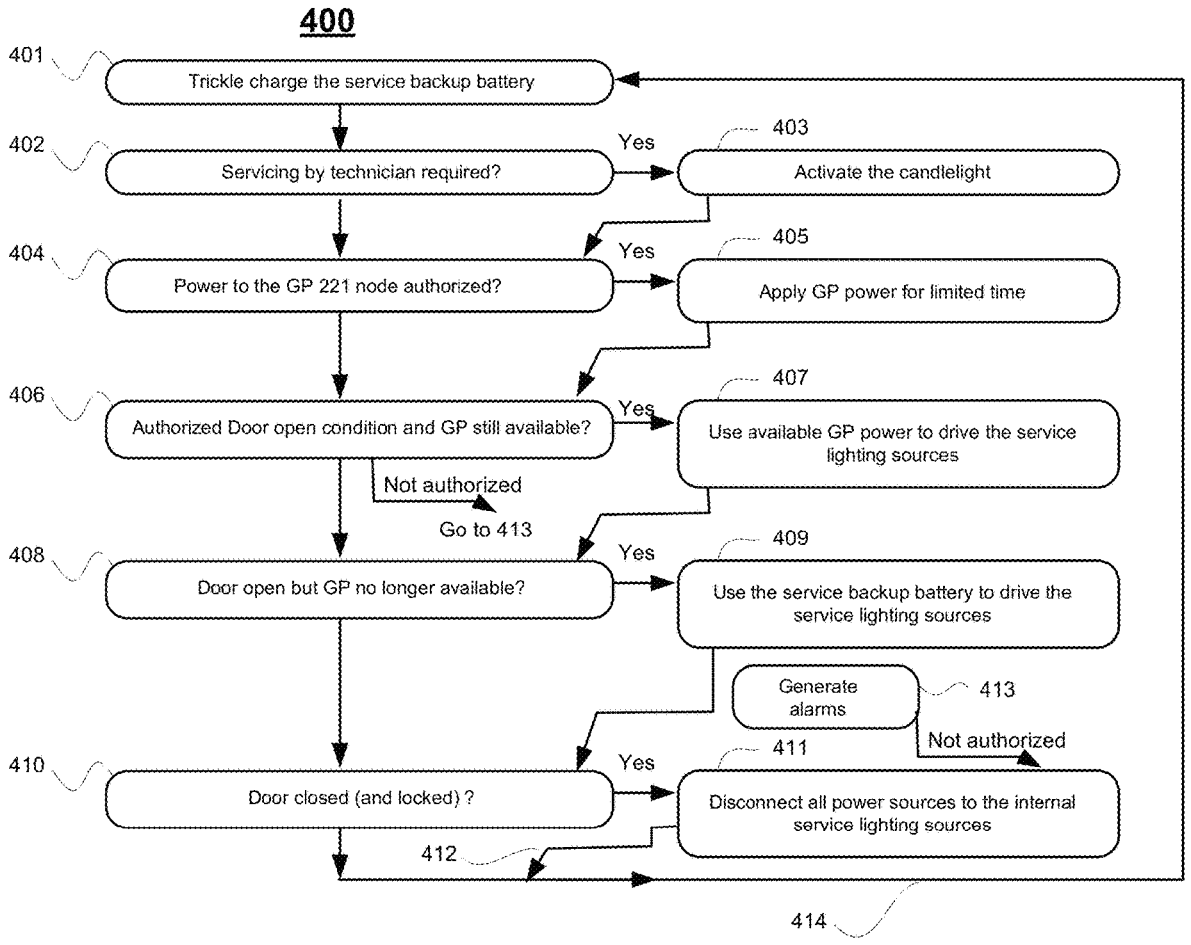
FIG. 4 is a flow chart depicting a service lighting continuation method for gaming cabinets in accordance with the present disclosure.

Referring to FIG. 4, shown is a flow chart of a method 400 of using a service lighting continuation circuit (e.g., that of one of FIGS. 2C, 3A-3C) in accordance with the present disclosure. An embodiment of the method may begin with long-term trickle charging 401 of the service backup battery (e.g., 235/335 of FIGS. 2C-3C) in cases where the service backup battery is a secondary battery and such trickle charging is desired. Otherwise step 401 may be omitted.

In step 402 the gaming control mechanisms (e.g., 210/310 of FIGS. 2C-3C) automatically determine if servicing by a technician is required. If yes, then in step 403 the technician summoning candlelight (e.g., 1005) is lit to summon a technician to the gaming machine (e.g., 1001) that is in need of such servicing. (Also in the optional embodiment of FIG. 3C where the OC service authorization latch 243 is included, the latch is turned on by the gaming control mechanisms.)

In subsequent step 404 it is automatically determined whether the power to the GP power node in the non-forbidden zone is authorized and if so, in step 405 the GP power is applied to node 221 for a predetermined amount of time (e.g., 30 minutes).

In subsequent step 406 a door open condition is detected. If not authorized, control automatically passes to step 413. In step 413, alarms are optionally generated and then control continues to step 411 in which all power sources to the internal service lighting sources are disconnected. On the other hand, if the door opening is authorized and GP power is still available at node 211 then control passes to step 407 where the available GP power is used to drive the internal service lighting sources (250) so that the technician can work on the components in the correspondingly accessed housing portion.

In step 408 it is determined whether the authorized door open condition is still present but the GP power is no longer available. If yes, control passes to step 409 in which the service backup battery is used to continue driving the service light sources (250/350). As a result, even if the technician continues to work on the accessed housing portion beyond the allotted time of step 405, convenient servicing light is provided as powered by the service backup battery.

In a subsequent step 410 it is determined that the door is closed and optionally also properly locked. In such a case, control passes to step 411 where all the power sources to the internal service lighting devices are disconnected and thus the cabinet internal lights are turned off. Control then continues along process paths 412 and 414 back to step 401 where, after the gaming machine is turned back on into normal operating mode, the trickle charging of the service backup battery is repeated.

It may be appreciated from the above that a gaming machine and method of operating the same are disclosed where the gaming machine includes one or more interior service lights and further comprises: a service backup battery; a gaming machine power node that at times can be depowered; a first sensor (e.g., doorway switch) operable to detect a doorway open condition for a doorway of the gaming machine; and a power coupling switch operable to selectively couple power from one of the gaming machine power node and the service backup battery to the service lights when the first sensor (e.g., doorway switch) indicates a doorway open condition to thereby provide light inside the gaming machine even when the gaming machine power node is depowered, the power coupling switch being operable to discontinue the providing of power to the service lights when the first sensor indicates a doorway closed condition. Decision making for driving the power coupling switch may be implemented in a variety of ways including, but not limited to, use of an analog OR circuit (e.g., one having diodes), use of logic gates, use of a programmed microcontroller and so on. The service backup battery may be trickled charged using power of the gaming machine power node so that the service backup battery is ready to provide service backup power when needed.

Although many of the components and processes are described above in the singular for convenience, it will be appreciated by one of skill in the art that multiple components and repeated processes can also be used to practice the techniques of the present disclosure. As used herein, the term "and/or" implies all possible combinations. In other words, A and/or B covers, A alone, B alone, and A and B together.

While the present disclosure of invention has been particularly shown and described with reference to specific embodiments thereof, it will be understood by those skilled in the art that changes in the form and details of the disclosed embodiments may be made without departing from the spirit or scope of the present teachings. It is therefore intended that the disclosure be interpreted to include all variations and equivalents that fall within the true spirit and scope of the present teachings.

What is claimed is:

1. A gaming machine including one or more service lights adapted to illuminate corresponding one or more normally closed interior portions of the gaming machine, the gaming machine comprising:

a gaming machine power node connecting to and receiving power conditionally from a secured power supply within a first portion of the gaming machine to which additional connections are forbidden, the secured power supply connecting to a secured first backup battery disposed within the first portion;

a service-assisting second backup battery;

a first switch operable to detect a doorway open condition for a doorway of the gaming machine; and a second switch operable to selectively couple power from one of the gaming machine power node and the service-assisting second backup battery to at least one of the service lights when the first switch indicates a doorway open condition, the second switch being operated by decision circuitry that decides whether to provide illuminating light inside the gaming machine by operation of the second switch even when, due to conditions, the gaming machine power node is not receiving power from the secured power supply.

2. The gaming machine of claim 1 wherein the decision circuitry includes logic gates having logic input terminals operating in a voltage range of the gaming machine power node.

3. The gaming machine of claim 1 wherein the decision circuitry includes source selection circuitry that decides which of the gaming machine power node and the service-assisting second backup battery will be used to couple power to at least one of the service lights when the first switch indicates a doorway open condition.

4. The gaming machine of claim 1 wherein the decision circuitry operates to discontinue the provision of power to the one or more service lights in response to the first switch indicating a doorway closed condition.

5. The gaming machine of claim 1 wherein the decision circuitry comprises:

a power sources interface circuit coupled to receive backup power from the service-assisting second backup battery and to receive primary power from the gaming machine power node, the power sources interface circuit selectively coupling power from at least one of the gaming machine power node and the service-assisting second backup battery to a service power providing node of the power sources interface circuit; and wherein the second switch is connected to receive power from the service power providing node.

6. The gaming machine of claim 5, wherein the power sources interface circuit selectively couples to the service power providing node, power from a one of the gaming machine power node and the service-assisting second backup battery having a greater voltage than that of the other.

7. The gaming machine of claim 6, wherein the power sources interface circuit includes a first diode connected to supply the voltage of the gaming machine power node to the service power providing node in the event that the voltage of the gaming machine power node is greater than that of the service-assisting second backup battery and a second diode connected to supply the voltage of the service-assisting second backup battery to the service power providing node in the event that the voltage of the service-assisting second backup battery is greater than that of the gaming machine power node.

8. The gaming machine of claim 7, wherein the power sources interface circuit includes a third diode connected to supply trickle charging current to the service-assisting second backup battery using power supplied from gaming machine power node.

9. The gaming machine of claim 5, wherein the second switch is operably coupled to the first switch such that when the first switch detects a doorway open condition, the second switch changes state from that of not coupling power from the service power providing node of the power sources interface circuit to the at least one of the service lights to that of coupling said power to the at least one of the service lights.

10. The gaming machine of claim 5, wherein the second switch is part of a normally open electromagnetic relay that switches state to turn the at least one of the service lights on when the relay is energized by a voltage having at least a predetermined minimum value.

11. The gaming machine of claim 5, wherein the first switch couples a door sense line to ground when the doorway is closed.

12. The gaming machine of claim 5, wherein the service lights include one or more light emitting diodes coupled to the second switch.

13. The gaming machine of claim 5, wherein the second switch includes a field effect transistor operatively coupled to be controlled by the first switch.

14. The gaming machine of claim 5, wherein the power sources interface circuit includes a field effect transistor operatively coupled to be controlled by voltage at the gaming machine power node.

15. A service lighting continuation method used with a normally secured gaming machine having one or more technician accessible and normally locked compartments that include one or more compartment service lights configured to illuminate their corresponding normally locked compartments, the method comprising:

automatically supplying to a service power supplying node in a respective one of the compartments, power from one or another of a gaming machine power supply node (GP) and a service backup battery (BP), where the gaming machine power node connects to and receives power conditionally from a secured power supply within a first portion of the gaming machine to which additional connections are forbidden, the secured power supply having its own, secured backup battery;

automatically detecting if at least one of a compartment unlocked and compartment doorway open condition is true for the respective one of the compartments; and concurrently with detecting that at least one of the compartment unlocked and compartment doorway open condition is true, automatically coupling an otherwise not so coupled one or more of the service lights of the respective one of the compartments to the service power supplying node; and concurrently with detecting that both of the compartment unlocked and compartment door open conditions are false, automatically decoupling the service power supplying node from the one or more of the service lights of the respective one of the compartments.

16. The method of claim 15 wherein the respective one of the compartments includes a not-forbidden zone to which additional connections cant be made and wherein the service backup battery (BP) and the gaming machine power supply node (GP) are located in the not-forbidden zone.

17. The method of claim 16 wherein said automatic supplying to the service power supplying node of power from one or another of the gaming machine power supply node (GP) and the service backup battery (BP) is performed by an analog OR circuit that picks the one of the gaming machine power supply node (GP) and the service backup battery (BP) having a greater voltage to be supplied to the service power supplying node.

18. The method of claim 17 wherein said analog OR circuit includes two diodes.

19. The method of claim 15 and further comprising:

automatically trickle recharging the service backup battery (BP) using power obtained from the gaming machine power supply node (GP).

20. The method of claim 15 wherein said concurrent detecting that at least one of the compartment unlocked and compartment doorway open condition is true and said automatic coupling of the otherwise not so coupled one or more of the service lights to the service power supplying node is performed using a switch having first and second armatures that switch state in unison.

21. The method of claim 15 wherein said concurrent detecting that at least one of the compartment unlocked and compartment doorway open condition is true and said automatic coupling of the otherwise not so coupled one or more of the service lights to the service power supplying node is performed using a normally open magnetic relay.

22. The method of claim 15 wherein said concurrent detecting that at least one of the compartment unlocked and compartment doorway open condition is true and said automatic coupling of the otherwise not so coupled one or more of the service lights to the service power supplying node is performed using a field effect transistor.

23. A method of servicing a normally secured gaming machine having one or more technician accessible and normally locked compartments that include respective compartment illuminating service lights, the method comprising:

summoning a service technician to the gaming machine;

authorizing the summoned technician to unlock and open at least one of the normally locked compartments of the gaming machine;

automatically supplying to a service power supplying node in the at least one authorized compartment, power from one or another of a gaming machine power supply node (GP) and a service backup battery (BP), the gaming machine power supply node connecting to and receiving power conditionally from a secured power supply within a first portion of the gaming machine to which additional connections are forbidden, where under some conditions the secured power supply stops supplying power to the gaming machine power supply node;

automatically detecting if at least one of a compartment unlocked and compartment doorway open condition is true for the at least one authorized compartment; and concurrently with detecting that at least one of the authorized compartment unlocked and compartment doorway open condition is true, automatically coupling an otherwise not so coupled one or more of the compartment illuminating service lights of the at least one authorized compartment to the service power supplying node; and concurrently with detecting that at least the second of the authorized compartment unlocked and compartment door open condition is false, automatically decoupling the service power supplying node from the one or more of the compartment illuminating service lights of the at least one authorized compartment.

24. The method of claim 23 wherein the authorized compartment includes a not-forbidden zone to which additional connections can be made and wherein the service backup battery (BP) and the gaming machine power supply node (GP) are located in the not-forbidden zone.

25. A circuit having at least a portion thereof included inside of a normally locked but technician serviceable, secured compartment of a gaming machine, the secured compartment having a service light configured to illuminate the compartment, the circuit comprising:

a battery-backed primary power means and a service-extending backup power means, the battery-backed primary power means being disposed in a portion of the gaming machine to which additional connections are forbidden, the service-extending backup power means being disposed in a portion of the gaming machine to which additional connections are not forbidden;

a means for selectively coupling power from one of the primary power means and the service-extending backup power means to the service light inside the secured compartment of the gaming machine and for selectively discontinuing the coupling of the power;

sensor means for generating an open access signal that indicates the secured compartment is unlocked; and decision circuitry means for processing the open access signal and status of the battery-backed primary power means and of the service-extending backup power means and responsively operating the means for selectively coupling power to turn the service light on and off.

26. The circuit of claim 25 wherein:

the battery-backed primary power means is normally used to power gaming operations of the gaming machine but can at times fail to provide power;

the service-extending backup power means includes a backup battery not used to power gaming operations of the gaming machine; and different output voltages are provided respectively by the battery-backed primary power means and the service-extending backup power means when both are operational.

27. The circuit of claim 25 wherein:

the means for selectively coupling power is operated to use the power of a one of the battery-backed primary power means and the service-extending backup power means that has the greater voltage when coupling power to the service light.

* * * * *